US008487843B2

(12) United States Patent
Goh et al.

(10) Patent No.: US 8,487,843 B2
(45) Date of Patent: Jul. 16, 2013

(54) DISPLAY DEVICE AND DRIVING METHOD THEREOF

(75) Inventors: Joon-Chul Goh, Hwaseong-si (KR); Chong-Chul Chai, Seoul (KR); Young-Soo Yoon, Suwon-si (KR); Sei-Hyoung Jo, Seoul (KR)

(73) Assignee: Samsung Display Co., Ltd., Suwon-Si, Gyeonggi-Do (KR)

( * ) Notice: Subject to any disclaimer, the term of this patent is extended or adjusted under 35 U.S.C. 154(b) by 706 days.

(21) Appl. No.: 12/468,697

(22) Filed: May 19, 2009

(65) Prior Publication Data

US 2010/0123697 A1 May 20, 2010

(30) Foreign Application Priority Data

Nov. 17, 2008 (KR) ..... 10-2008-0114094

(51) Int. Cl.
*G09G 3/30* (2006.01)

(52) U.S. Cl.
USPC ..... 345/76; 345/82; 345/204; 315/169.3

(58) Field of Classification Search
USPC ..... 345/76–83, 204; 315/169.3
See application file for complete search history.

(56) References Cited

U.S. PATENT DOCUMENTS

2004/0252089 A1 12/2004 Ono et al.
2005/0052377 A1 3/2005 Hsueh
2005/0083270 A1* 4/2005 Miyazawa ..... 345/76
2005/0093787 A1* 5/2005 Kim et al. ..... 345/76
2005/0206591 A1 9/2005 Wang et al.
2006/0066532 A1* 3/2006 Jeong ..... 345/76
2006/0077194 A1* 4/2006 Jeong ..... 345/204
2006/0158397 A1* 7/2006 Goh ..... 345/76
2006/0244695 A1* 11/2006 Komiya ..... 345/76
2009/0262101 A1* 10/2009 Nathan et al. ..... 345/211

FOREIGN PATENT DOCUMENTS

KR 10-2004-0009285 1/2004
KR 10-2005-0038906 4/2005
KR 10-2005-0049827 5/2005
KR 10-2005-0109166 11/2005
KR 10-0592636 6/2006

OTHER PUBLICATIONS

English Abstract for Publication No. 10-2004-0009285.
English Abstract for Publication No. 10-2005-0038906.
English Abstract for Publication No. 10-2005-0049827.
English Abstract for Publication No. 10-2005-0109166.
English Abstract for Publication No. 10-0592636.

* cited by examiner

*Primary Examiner* — Koosha Sharifi-Tafreshi
(74) *Attorney, Agent, or Firm* — F. Chau & Associates, LLC

(57) ABSTRACT

A display device and a method of driving the display device are provided. The threshold voltage of a driving transistor is compensated such that even when the threshold voltage of the driving transistor is varied, the emission of light with respect to a predetermined data voltage occurs with a predetermined luminance, based on a diode-connected compensation transistor and a plurality of switching transistors.

15 Claims, 8 Drawing Sheets

DISPLAY DEVICE AND DRIVING METHOD THEREOF

CROSS-REFERENCE TO RELATED APPLICATION

This application claims priority to and the benefit of Korean Patent Application No. 10-2008-0114094 filed in the Korean Intellectual Property Office on Nov. 17, 2008, the entire contents of which are incorporated herein by reference.

BACKGROUND OF THE INVENTION (a) Field of the Invention

The present disclosure relates to a display device and a method of driving the same, and more particularly, to an organic light emitting diode (OLED) display and a driving method thereof.

(b) Discussion of the Related Art

In order to make monitors and televisions thin and lightweight, cathode ray tubes (CRT) are being replaced by liquid crystal displays (LCD). However, the LCD as a non-emissive device is typically provided with a separate backlight to display images, and is limited in response time and viewing angle.

As an alternative, an OLED display has recently been developed as a display device capable of overcoming such shortcomings.

The OLED display includes a plurality of organic light emitting elements, which have an anode, a cathode, and an organic light emitting member sandwiched between the anode and the cathode. Pixels for the OLED display have thin film transistors (TFT) for driving the organic light emitting elements, and when the TFTs are operated for a long period of time, the threshold voltage varies such that it becomes difficult to achieve expected luminance. Such a problem may occur due to the difference in threshold voltage of the TFTs induced by wide-ranging inter-pixel semiconductor characteristic variation.

SUMMARY OF THE INVENTION

In accordance with the embodiments of the present invention a display device and a driving method thereof are provided which prevent deterioration of image quality due to variations in the threshold voltage of driving thin film transistors and the difference in threshold voltage of the inter-pixel driving thin film transistors, thus improving image quality.

An exemplary embodiment of the present invention provides a display device including a plurality of pixels each with an organic light emitting element, such as an OLED, a driving transistor, a compensation transistor, and a first switching transistor. The driving transistor has a control element, an input element, and an output element, and applies a current to the organic light emitting element through the output terminal. The compensation transistor has a control terminal, an input terminal, and an output terminal. The control and input terminals of the compensation transistor are connected to the control terminal of the driving transistor. The first switching transistor has a control terminal, an input terminal, and an output terminal. The output terminal of the first switching transistor is connected to the output terminal of the compensation transistor. The control terminal is connected to a gate line of a present row. The input terminal is connected to a data line.

When the control terminal of the driving transistor and the control and the input terminals of the compensation transistor contact each other at a first contact point, the display device may further include a second switching transistor having a control terminal connected to a gate line of a previous row, an input terminal, and an output terminal connected to the first contact point.

An initial voltage may be applied to the input terminal of the second switching transistor.

The initial voltage may have a higher value than a maximum value of a data voltage input through the data line.

The display device may further include a third switching transistor having a control terminal, an input terminal connected to the driving voltage, and an output terminal connected to the input terminal of the driving transistor.

The input terminal of the second switching transistor may be connected to the driving voltage.

The control terminal of the third switching transistor may be connected to a first signal line, to which a high voltage is applied when a low voltage is applied to the gate line of the present row and the gate line of the previous row.

When the output terminal of the driving transistor and the organic light emitting element contact each other at a second contact point, the display device may further include a fourth switching transistor having a control terminal, an input terminal connected to a reference voltage, and an output terminal connected to the second contact point.

The control terminal of the fourth switching transistor may be connected to a second signal line, to which the low voltage is applied when the low voltage is applied to the gate line of the present row and the gate line of the previous row.

The low voltage applied to the first to fourth switching transistors may turn off the first to fourth switching transistors, respectively.

The low voltage applied to the first to third switching transistors may turn off the first to third switching transistors, respectively, and the low voltage applied to the fourth switching transistor may make a predetermined magnitude of current flow through the fourth switching transistor.

When the low voltage is applied to the fourth switching transistor, a current of several nA may flow through the fourth switching transistor.

The display device may further include a capacitor disposed between the first and second contact points to interconnect the first and second contact points.

The display device may further include a scan driver for generating signals applied to the control terminals of the first to fourth switching transistors, respectively, a data driver for generating data voltages applied to the data line, and a signal controller for controlling the scan and data drivers.

An exemplary embodiment of the present invention provides a method of driving a display device. A gate-on signal is first applied during a first time period to a gate line of a previous row to initialize a voltage of a first contact point connected to a control terminal of a driving transistor with an initial voltage. The gate-on signal is applied during a second time period to a gate line of a present row to turn on a first switching transistor connected to the gate line, and the voltage of the first contact point is converted into the sum of a data voltage and a threshold voltage. A driving voltage is applied during a third time period to an input terminal of the driving transistor such that the driving transistor transmits a current to an organic light emitting element through an output terminal thereof.

During the initializing the voltage of the first contact point with the initial voltage, the initial voltage may be applied to the first contact point by a second switching transistor having an output terminal connected to the first contact point, a control terminal connected to the gate line of the previous row, and an input terminal connected to the initial voltage.

The initial voltage may have a higher value than the maximum value of the data voltage.

The initial voltage may be the driving voltage.

During the converting the voltage of the first contact point to the sum of the data voltage and the threshold voltage, the first switching transistor may turn on such that the data voltage is applied to the first contact point through the data line connected to the input terminal of the first switching transistor. However, since the voltage of the first contact point becomes higher than the data voltage, a current flows from the first contact point toward the data line such that the voltage of the first contact point becomes the sum of the data voltage and the threshold voltage.

During the converting the voltage of the first contact point to the sum of the data voltage and the threshold voltage, a current may flow through the first switching transistor having a control terminal connected to the gate line of the present row and an input terminal connected to the data line, a compensation transistor having control and input terminals connected to the first contact point, and an output terminal connected to the output terminal of the first switching transistor.

The applying the driving voltage to the input terminal of the driving transistor to transmit a current to the organic light emitting element through the output terminal of the driving transistor may include applying the driving voltage to the driving transistor through a third switching transistor having an output terminal connected to the input terminal of the driving transistor and an input terminal connected to the driving voltage.

The control signal input into the control terminal of the third switching transistor may turn off the third switching transistor during the first and second steps, and turn on the third switching transistor during the third step.

During the initializing the voltage of the first contact point with the initial voltage and the converting the voltage of the first contact point into the sum of the data voltage and the threshold voltage may include inputting a reference voltage to the second contact point connected with the output terminal of the driving transistor and the organic light emitting element through the output terminal of the fourth switching transistor connected thereto.

The control signal input to the control terminal of the fourth switching transistor may turn on the fourth switching transistor during the first and second steps, and turn off the fourth switching transistor during the third step.

The control signal input into the control terminal of the fourth switching transistor may turn on the fourth switching transistor during the first time period and the second time period, and may cause a predetermined magnitude of current to flow through the fourth switching transistor during the third time period.

The magnitude of current flowing through the fourth switching transistor may be several nA.

Based on the above-identified new pixel structure, the variation in the threshold voltage of the driving thin film transistor and the difference in threshold voltage among the driving thin film transistors of different pixels are compensated to thereby display a predetermined luminance with a predetermined data voltage, and the display quality of the display device is improved.

DETAILED DESCRIPTION OF THE EMBODIMENTS

Figure 1:
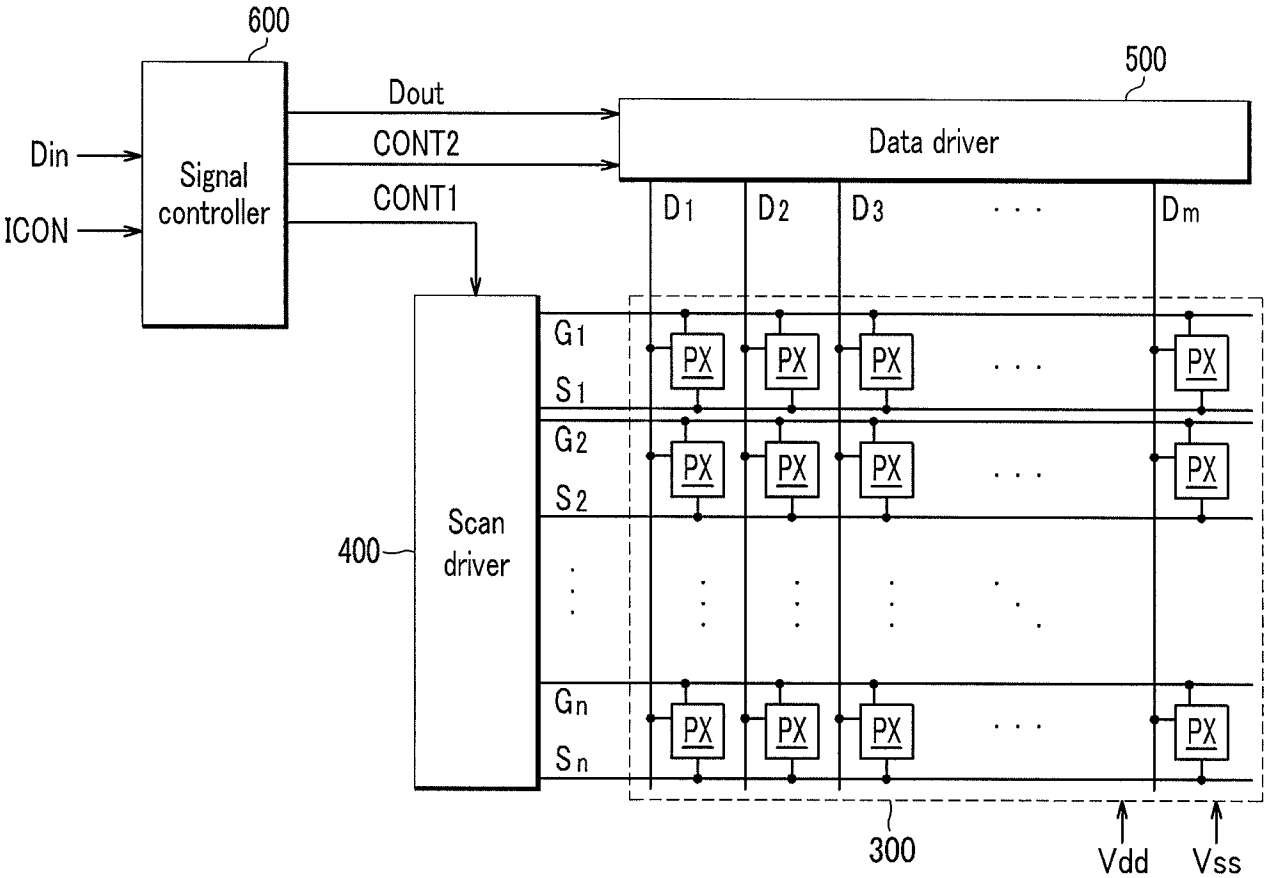
FIG. 1 is a block diagram of an OLED display according to an exemplary embodiment of the present invention.
Figure 2:
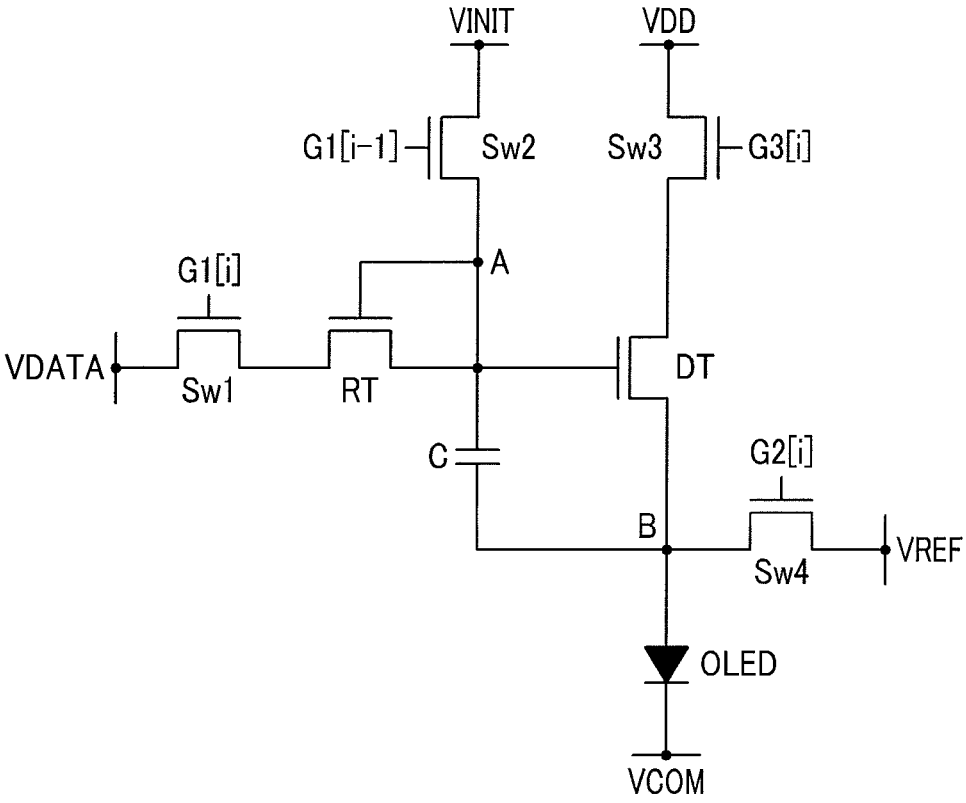
FIG. 2 is an equivalent circuit diagram of a pixel in an OLED display according to an exemplary embodiment of the present invention.

Referring now to FIGS. 1 and 2, an OLED display includes a display panel 300, a scan driver 400, a data driver 500, and a signal controller 600.

The display panel 300 includes a plurality of signal lines G1, G2 . . . Gn, S1 . . . Sn, and D1, D2, D3 . . . Dm, a plurality of voltage lines (not shown), and a plurality of pixels PX connected thereto and arranged roughly in the form of a matrix.

The signal lines G1, G2 . . . Gn, S1 . . . Sn, and D1, D2, D3 . . . Dm include a plurality of scan signal lines G1, G2 . . . Gn for transmitting scan signals, a plurality of compensation signal lines S1 . . . Sn for transmitting compensation signals, and a plurality of data lines D1, D2, D3 . . . Dm for transmitting data signals. The scan signal lines G1, G2 . . . Gn and the compensation signal lines S1, S2 . . . Sn are in a row direction and are substantially parallel to each other. The data lines D1, D2, D3 . . . Dm are in a column direction and are substantially parallel to each other. Although the compensation signal lines S1, S2 . . . Sn are each indicated by a line in FIG. 1, those lines each have second and third lines G2[1] to G2[*n*] and G3[1] to G3[*n*] as shown in FIG. 2. The scan signal lines G1, G2 . . . Gn are indicated by first gate lines G1[1] to G1[*n*] in FIG. 2 in order to distinguish them from the second and third gate lines.

The voltage lines include driving voltage lines (not shown) for transmitting driving voltages.

As shown in FIG. 2, the pixel PX includes an OLED, a driving transistor DT, a capacitor C, four switching transistors Sw1, Sw2, Sw3, Sw4, and a diode-connected compensation transistor RT.

The driving transistor DT, the four switching transistors Sw1, Sw2, Sw3, Sw4, and the compensation transistor RT each have an output terminal, an input terminal, and a control terminal. Description will now be given with reference to a pixel of an i-th row. The i-th row is referred to as the present row, and the (i−1)th row as the previous row.

The control terminal of the first switching transistor Sw1 is connected to the first gate line G1[*i*] of the present row, and the input terminal thereof to the data line VDATA, while the output terminal of the first switching transistor Sw1 is connected to the output terminal of the compensation transistor RT.

The compensation transistor RT is diode-connected, and the control and the input terminals thereof are connected to the driving transistor DT and the second switching transistor Sw2 via a contact point A.

The output terminal of the second switching transistor Sw2 is connected to the contact point A and the control terminal thereof is connected to the first gate line G1[*i*−1] of the previous row, while the input terminal of the second switching transistor Sw2 is connected to a wire (referred to hereinafter as the "initial voltage wire") for applying an initial voltage VINIT. The initial voltage VINIT may have a higher value than the maximum value of the data voltage VDATA.

The capacitor C is formed between the contact point A and a contact point B, and is connected to the compensation transistor RT, the second switching transistor Sw2, and the driving transistor DT via the contact point A while being connected to the OLED, the fourth switching transistor Sw4, and the driving transistor DT via the contact point B.

The control terminal of the driving transistor DT is connected to the contact point A, the input terminal thereof is connected to the third switching transistor Sw3, while the output terminal thereof is connected to the contact point B.

The control terminal of the third switching transistor Sw3 is connected to the third gate line G3[*i*] and the input terminal thereof is connected to the driving voltage line for applying a driving voltage VDD, while the output terminal thereof is connected to the input terminal of the driving transistor DT.

The control terminal of the fourth switching transistor Sw4 is connected to the second gate line G2[*i*] and the input terminal thereof is connected to a reference voltage line for applying a reference voltage VREF, while the output terminal thereof is connected to the contact point B.

The switching transistors Sw1, Sw2, Sw3, Sw4, the compensation transistor RT, and the driving transistor DT may be thin film transistors (TFT), and contain polycrystalline silicon or amorphous silicon.

The anode and the cathode of the OLED are connected to the contact point B and the common voltage VCOM, respectively. The OLED emits light that is differentiated in intensity depending upon the magnitude of current from the driving transistor DT to thereby display images. The magnitude of the current depends upon the magnitude of the voltage between the control and input terminals of the driving transistor DT (the magnitude of the voltage stored at the capacitor C).

Referring to FIG. 1 again, the scan driver 400 is connected to the scan signal lines G1, G2 . . . Gn and the compensation signal lines S1 . . . Sn of the display panel 300 so as to apply the scan and compensation signals with combinations of a high voltage Von and a low voltage Voff thereto, respectively.

A high voltage Von turns on the switching transistors Sw1, Sw2, Sw3, Sw4, and a low voltage Voff turns off the switching transistors Sw1, Sw2, Sw3, Sw4.

The data driver 500 is connected to the data lines D1, D2, D3 . . . Dm of the display panel 300 so as to apply the data voltages VDATA expressing image signals to the data lines D1, D2, D3 . . . Dm.

The signal controller 600 controls the operations of the scan driver 400 and the data driver 500.

The drivers 400, 500 and signal controller 600 may be directly mounted on the display panel 300 in the form of at least one IC chip, or attached to the display panel 300 in the form of a tape carrier package (TCP) while mounted on a flexible printed circuit film (not shown). The drivers 400, 500 and signal controller 600 can also be mounted on a separate printed circuit board (PCB, not shown). Alternatively, the drivers 400, 500 and signal controller 600 may be integrated on a display panel 300 together with the signal lines G1, G2 . . . Gn, S1 . . . Sn, and D1, D2, D3 . . . Dm, the switching transistors Sw1, Sw2, Sw3, Sw4, the compensation transistors RT and the driving transistors DT. Furthermore, the drivers 400, 500 and signal controller 600 may be integrated in a single chip, and in this case, at least one of the drivers or signal controller, or at least one circuit thereof, may be placed external to the single chip.

The display operation of the OLED display will now be described in more detail with reference to FIGS. 3 to 6, as well as to FIGS. 1 and 2.

Figure 3:
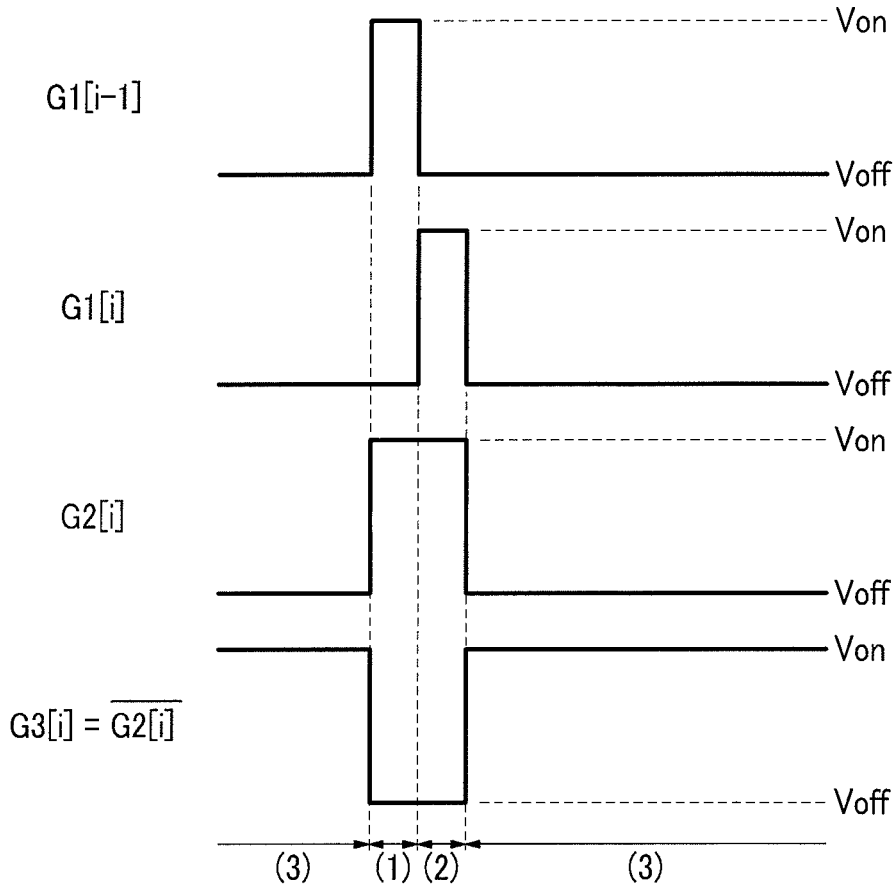
FIG. 3 is a waveform diagram of driving signals applied to a pixel of a row in an OLED display according to an exemplary embodiment of the present invention.
Figure 4:
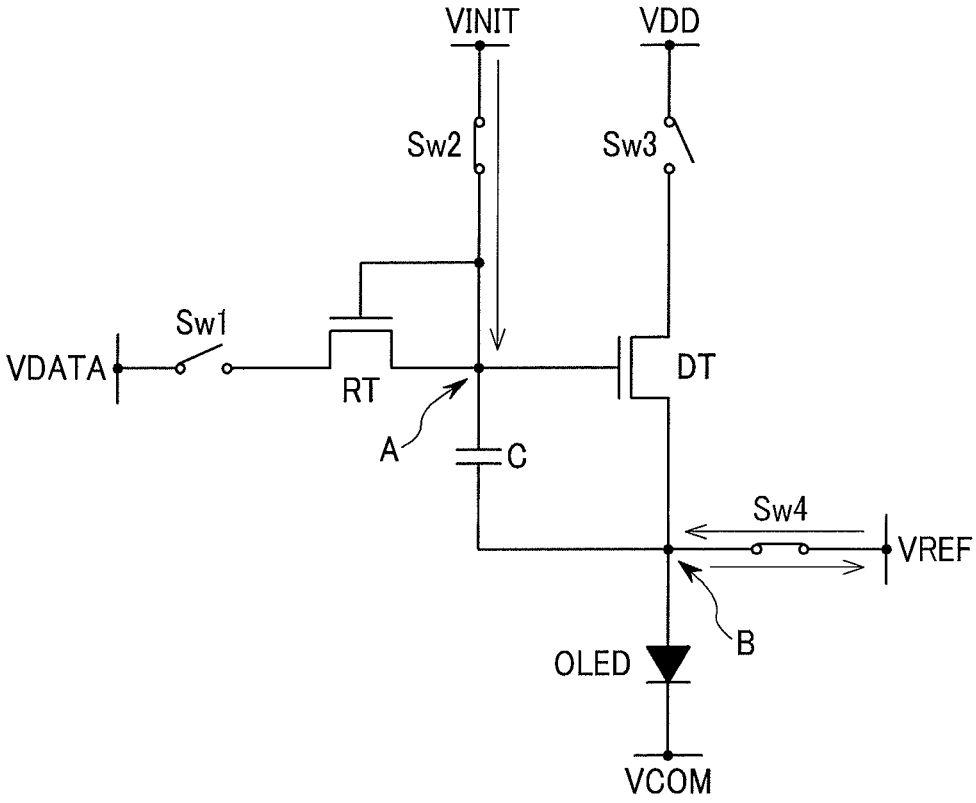
FIGS. 4, 5 and 6 are equivalent circuit diagrams illustrating the operation states of the pixel shown in FIGS. 2 and 3.
Figure 5:
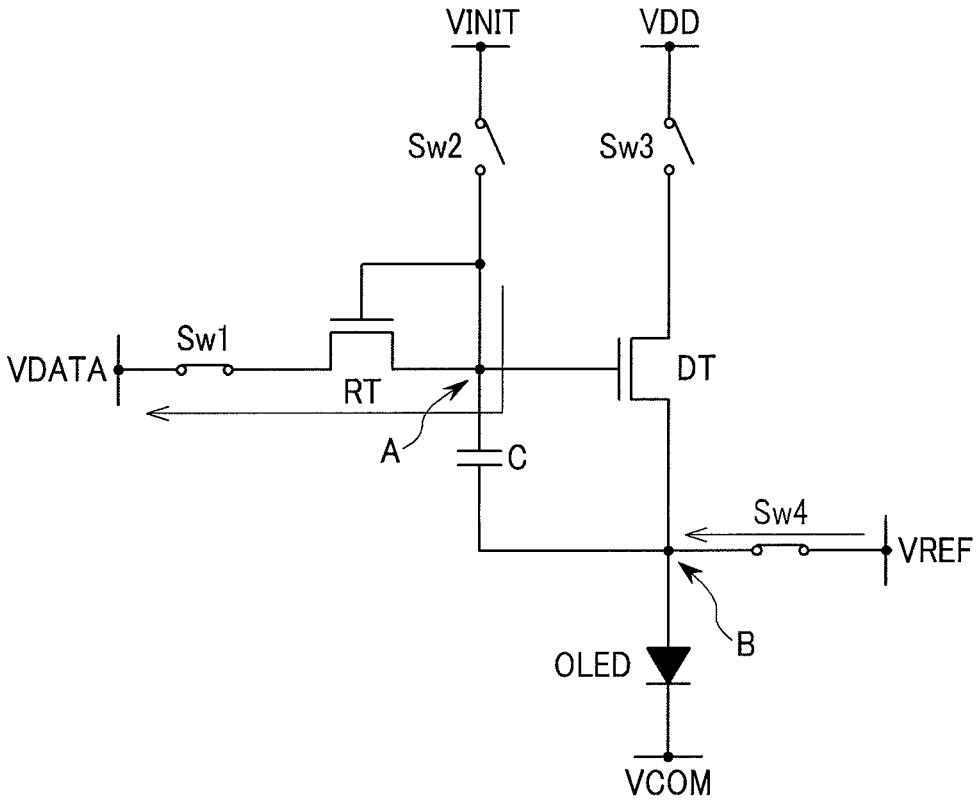
Figure 6:
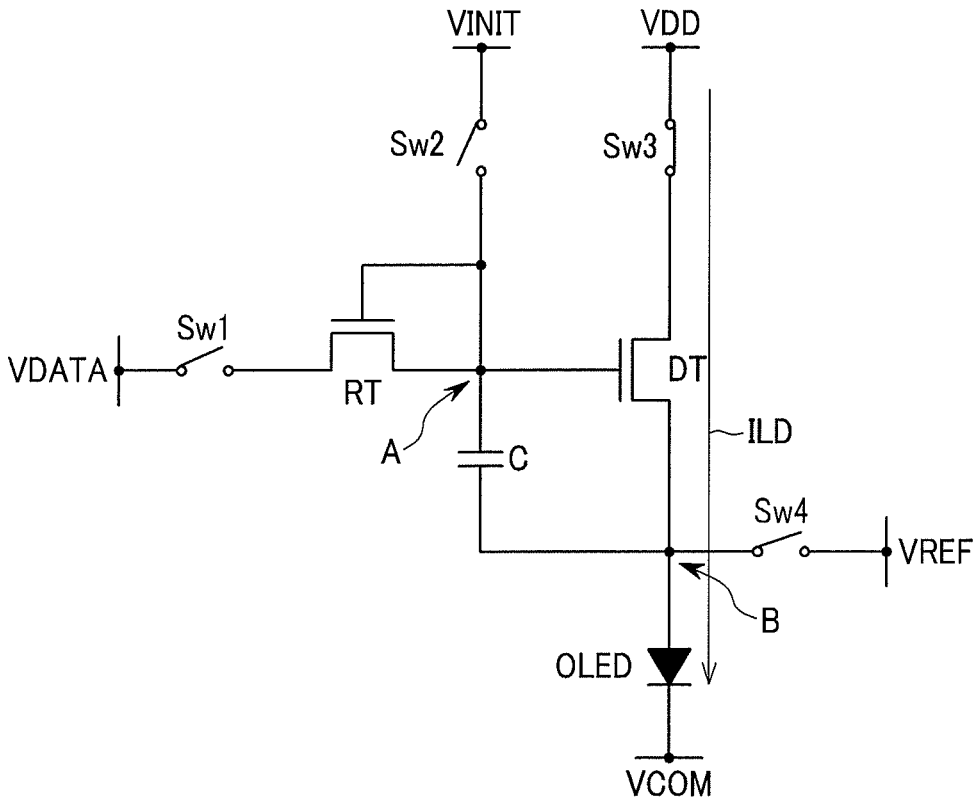

FIG. 3 is a waveform diagram of driving signals applied to a pixel of a row in an OLED display according to an exemplary embodiment of the present invention, and FIGS. 4 to 6 are equivalent circuit diagrams illustrating the operational states of the pixel shown in FIGS. 2 and 3.

The signal controller 600 receives input image signals Din and input control signals ICON for controlling those image signals from an external graphics controller (not shown). The input image signals Din contain information about the luminance of the respective pixels PX, and the luminance has a predetermined number of grays, for example, $1024=2^{10}$, $256=2^{8}$ or $64=2^{6}$ grays. The input control signals ICON include vertical synchronization signals, horizontal synchronization signals, main clock signals and data enable signals.

Upon receipt of the input image signals Din and the input control signals ICON, the signal controller 600 processes the input image signals Din depending upon the operating conditions of the display panel 300, and generates scan control signals CONT1 and data control signals CONT2. The signal controller 600 transmits the scan control signals CONT1 to the scan driver 400 and transmits the data control signals CONT2 and the output image signals Dout to the data driver 500.

The scan control signals CONT1 include scan start signals STV instructing to start the scanning of the high voltage Von with respect to the scan signal lines G1, G2 . . . Gn and the compensation signal lines S1 . . . Sn, at least one clock signal controlling the output cycle of the high voltage Von, and output enable signals OE defining the duration time of the high voltage Von.

The data control signals CONT2 include horizontal synchronization start signals informing of the transmission start of the digital image signals Dout with respect to the pixels PX of one row, load signals instructing to apply analog data voltages to the data lines D1, D2, D3 . . . Dm, and data clock signals HCLK.

In accordance with the scan control signals CONT1 from the signal controller 600, the scan driver 400 sequentially converts the scan signals applied to the scan signal lines G1, G2 . . . Gn and the compensation signals applied to the compensation signal lines S1 . . . Sn into the high voltage Von, and re-converts them into the low voltage Voff.

In accordance with the data control signals CONT2 from the signal controller 600, the data driver 500 receives the digital output image signals Dout with respect to the pixels of the respective rows, and converts them into analog data voltages VDATA, followed by applying them to the data lines D1, D2, D3 . . . Dm. The data driver 500 outputs the data voltages VDATA with respect to the pixels PX of one row for one horizontal time period 1H.

Description will now focus on a particular pixel row, for instance the i-th row. In the drawing of FIG. 3, i indicates the present row, and i−1 indicates the previous row.

Referring to FIGS. 1, 2 and 3, the scan driver 400, depending upon the scan control signal CONT1 from the signal controller 600, sequentially converts the gate signals applied to the first gate lines G1[*i*−1], G1[*i*] from the low voltage Voff into the high voltage Von, per horizontal time period of 1H. Therefore, the high voltage Von is applied to the first gate line G1[*i*−1] of the previous row for 1H, and is then applied to the first gate line G1[*i*] of the present row for 1H. In the drawing of FIG. 3, the time 1H of application of the high voltage Von to the first gate line G1[*i*−1] of the previous row is indicated by a first time period (1), and the time 1H of application of the high voltage Von to the first gate line G1[*i*] of the present row is indicated by a second time period (2). The remaining time is indicated by a third time period (3).

The scan driver 400, depending upon the scan control signal CONT1 from the signal controller 600, applies the high voltage Von to the second gate line G2[*i*] from the time point of starting the application of the high voltage Von to the first gate line G1[*i*−1] of the previous row to the time point of terminating the application of the high voltage Von to the first gate line G1[*i*] of the present row (i.e., during the second and third time periods (2) and (3)), and applies the low voltage Voff thereto for the remaining time (during the third time period (3)). A signal that is opposite in phase to the signal applied to the second gate line G2[*i*] is applied to the third gate line G3[*i*] such that the low voltage Voff is applied thereto during the first and second time periods (1), (2), and the high voltage Von is applied thereto during the third time period (3).

The pixel operation during the respective time periods will now be described in more detail with reference to FIGS. 4 to 6. FIG. 4 illustrates the pixel operation during the first time period (1). FIG. 5 illustrates the pixel operation during the second time period (2). FIG. 6 illustrates the pixel operation during the third time period (3).

Referring first to FIG. 4, the high voltage Von is applied to the first gate line G1[*i*−1] of the previous row and the second gate line G2[*i*], and the low voltage Voff is applied to the first gate line of the present row G1[*i*] and the third gate line G3[*i*]. Accordingly, the second and fourth switching transistors Sw2, Sw4 turn on, and the first and third switching transistors Sw1, Sw3 turn off.

During the first time period (1), the initial voltage VINIT is applied to the contact point A, and the reference voltage VREF is applied to the contact point B. At this time, since the initial voltage VINIT is high enough to turn on the driving transistor DT but the third switching transistor Sw3 connected to the input terminal of the driving transistor DT turns off, no voltage enters the input terminal thereof, and hence no current flows toward the OLED. Even when a voltage enters the input terminal and current flow occurs, the fourth switching transistor Sw4 connected to the contact point B turns on, and accordingly the current does not flow toward the OLED. At this time, the current is discharged through the fourth switching transistor Sw4, while the contact point B is maintained with the reference voltage VREF. As described above, the first time period (1) is the step where the voltages of the contact points A, B are initialized to have the initial voltage VINIT and the reference voltage VREF, respectively.

FIG. 5 illustrates the pixel operation during the second time period (2). The high voltage Von is applied to the first gate line G1[*i*] of the present row and the second gate line G2[*i*], and the low voltage Voff is applied to the first gate line G1[*i*−1] of the previous row and the third gate line G3[*i*]. Accordingly, the first and fourth switching transistors Sw1, Sw4 turn on, and the second and third switching transistors Sw2, Sw3 turn off.

During the second time period (2), the first switching transistor Sw1 turns on such that the data voltage VDATA is applied to the compensation transistor RT. The data voltage VDATA is applied to the output terminal of the compensation transistor RT, and the initial voltage VINIT charged during the first time period (1) is applied to the contact point A. Since the compensation transistor RT is diode-connected, the current flows from the high voltage to the low voltage, and since the initial voltage VINIT is established to be higher than the data voltage VDATA, the current is discharged from the contact point A toward the first switching transistor Sw1. That is, the voltage of the contact point A (the charge charged at the capacitor C) is discharged through the first switching transistor Sw1 via the compensation transistor RT. The discharging continues until the voltage difference between the control and input terminals of the driving transistor DT becomes a threshold voltage VTH of the driving transistor DT. As a result, the voltage of the contact point A is left at the amount of a sum of the data voltage VDATA and the threshold voltage VTH of the compensation transistor RT (VDATA+VTH, referred to hereinafter as the "control voltage of the driving transistor DT"). Meanwhile, the contact point B and the driving transistor DT are maintained in the same state as in the first time period (1) because no variations occur therewith. As described above, the second time period (2) is the step where the voltage of the contact point A is converted into the control voltage of the driving transistor DT (VDATA+VTH). Since the driving transistor DT and the compensation transistor RT placed within one pixel close to each other have the same characteristic, and hence the same threshold voltage VTH, the threshold voltage VTH being that of the compensation transistor RT will now be described as the threshold voltage VTH of the driving transistor DT.

FIG. 6 illustrates the pixel operation during the third time period (3). The high voltage Von is applied to the third gate line G3[*i*], and the low voltage Voff is applied to the first gate lines G1[*i*−1] and G1[*i*] of the present and previous rows and the second gate line G2[*i*]. Accordingly, the third switching transistor Sw3 turns on, and the first, second, and fourth switching transistors Sw1, Sw2, Sw4 turn off.

During the third time period (3), the third switching transistor Sw3 turns on such that the driving voltage VDD is applied to the input terminal of the driving transistor DT. The driving voltage VDD applied to the input terminal outputs a current ILD to the output terminal by way of the control voltage charged at the A terminal (VDATA+VTH), and the output current ILD flows through the OLED. The OLED emits light depending upon the dimension of current flow ILD to thereby display grays. During the third time period (3), which is longer than the first and second time periods, the driving voltage VDD is continuously applied to the input terminal of the driving transistor DT and the control voltage charged at the A terminal (VDATA+VTH) is maintained to be constant, such that the OLED continuously emits light with a predetermined luminance. Alternatively, as will be described below with reference to FIG. 7, it is possible for the light emission to not occur during some time periods.

As described above, the third time period (3) is the step where a current ILD flows through the OLED based on the control voltage (VDATA+VTH) of the contact point A and the driving voltage VDD applied to the input terminal of the driving transistor DT.

Since the control voltage of the contact point A contains the data voltage VDATA and the threshold voltage VTH of the driving transistor DT, even when the characteristic of the driving transistor DT varies such that the threshold voltage VTH thereof is altered, the voltage of the contact point A is also altered such that the driving transistor DT can output a predetermined current in accordance with the data voltage VDATA.

Furthermore, since the practical threshold voltage VTH is the threshold voltage of the compensation transistor RT, it may differ from the threshold voltage of the driving transistor DT, but the difference is extremely slight because the two transistors are placed within a pixel close to each other. Therefore, even when the threshold voltage of the driving transistor DT is differentiated due to an inter-pixel environmental difference in a wide area like a temperature difference, the voltage of the contact point A becomes the control voltage (VDATA+VTH), and the threshold voltage difference results in the difference in threshold voltage VTH between the compensation transistor RT and the driving transistor DT. In this way, a predetermined luminance can be displayed over the entire area of the OLED display.

The interconnection and operation of the respective pixel components have been specifically described thus far. The function of the respective pixel components within one pixel can be summarized as below.

The second switching transistor Sw2 has the function of applying the initial voltage VINIT to the contact point A in accordance with the first gate line G1[*i*−1] of the previous row.

The first switching transistor Sw1, depending upon the signal of the first gate line G1[*i*], outputs the data voltage VDATA from the output terminal thereof to apply it to the output terminal of the compensation transistor RT.

Since the compensation transistor RT is diode-connected, it discharges the voltage charged at the contact point A to the output terminal of the first switching transistor Sw1 such that the voltage of the contact point A is converted into the voltage corresponding to the sum of the data voltage VDATA and the threshold voltage VTH thereof. This is because the initial voltage VINIT is higher than the data voltage VDATA.

The third switching transistor Sw3 prevents the driving voltage VDD from being applied to the input terminal of the driving transistor DT for the time when the turn-on voltage is applied to the first gate line G1[*i*−1] of the previous row and the first gate line G1 [*i*] of the present row. Consequently, even when the high voltage is applied to the contact point A such that the driving transistor DT turns on, the driving voltage VDD is not applied to the OLED.

The fourth switching transistor Sw4 makes the voltage of the contact point B be the reference voltage VREF before the operation of the driving transistor.

The driving transistor DT, based on the voltage of the contact point A, transmits the input driving voltage VDD to the OLED connected to the contact point B such that the OLED is current-driven to emit light.

The capacitor C maintains the voltage between the contact points A, B to be constant, and the contact point B holding the reference voltage VREF particularly keeps the voltage of the contact point A constant.

An exemplary embodiment of the present invention, differing from that described with reference to FIGS. 2 to 6, will now be described in more detail.

Figure 7:
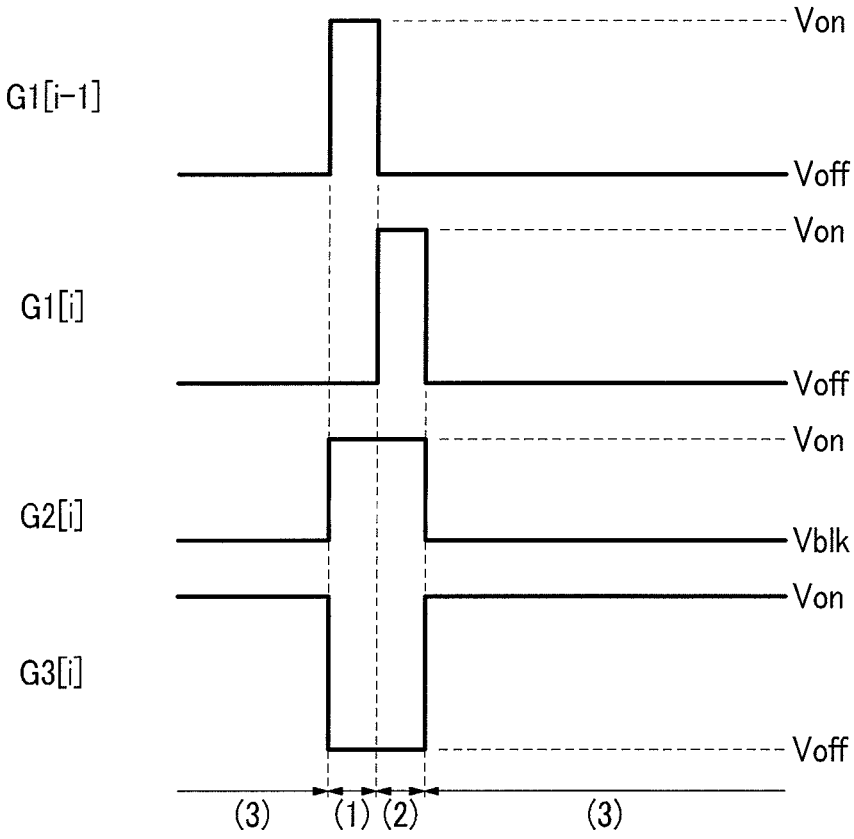
FIG. 7 is a waveform diagram of driving signals applied to a pixel of a row in an OLED display according to an exemplary embodiment of the present invention.

FIG. 7 is a waveform diagram of driving signals applied to a pixel of a row in an OLED display according to an exemplary embodiment of the present invention and illustrates the application of driving signals to the pixel of FIG. 2 in a different way from that illustrated in FIG. 3.

As shown in FIG. 7, the voltage applied to the fourth switching transistor Sw4 through the second gate line G2[*i*] has a value of Vblk as the low voltage, which is higher than the value of Voff. When the Voff voltage is applied to the control terminal of the fourth switching transistor Sw4, the current of 1 pA or less commonly flows to the output terminal, whereas when the Vblk voltage is applied thereto, the voltage value is established such that a current of several nA flows thereto.

With the signal application, the current of several nA continuously flows through the fourth switching transistor Sw4 during the third time period (3) such that the current ILD input to the contact point B and the charge charged at the capacitor C are discharged through the reference voltage VREF. Consequently, during the third time period (3) after the termination of the second time period (2), the amount of current ILD flowing through the OLED is reduced. The Vblk voltage may be controlled to increase the current flowing through the fourth switching transistor Sw4 such that the current flowing through the OLED becomes zero (0) before the termination of the third time period (3). In this case, since the OLED turns on and then turns off during the third time period (3), it become possible to cause impulsive driving.

Figure 8:
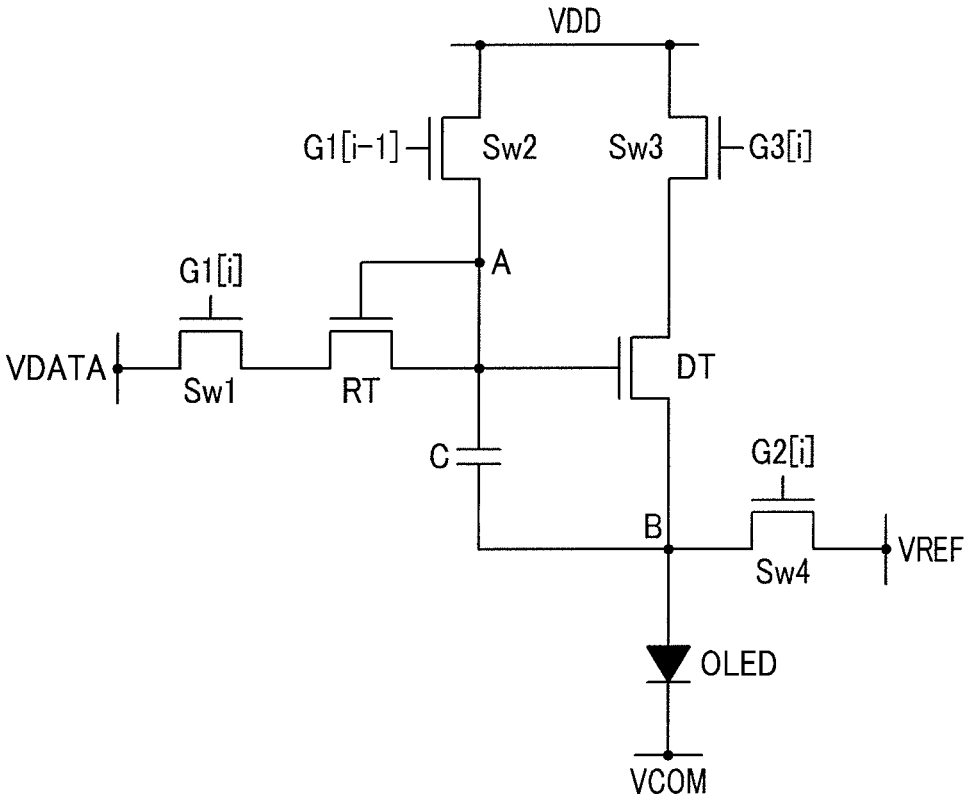
FIG. 8 is an equivalent circuit diagram of a pixel in an OLED display according to an exemplary embodiment of the present invention.

FIG. 8 illustrates a pixel with a different structure from that shown in FIG. 2 and is an equivalent circuit diagram of a pixel in an OLED display according to an exemplary embodiment of the present invention.

As shown in FIG. 8, the input terminals of the second and third switching transistors Sw2, Sw3 are commonly connected to the driving voltage VDD. Accordingly, in the case of FIG. 8 as compared with the case of FIG. 2, a wire is not needed to be formed for applying the initial voltage VINIT. As such, the pixel structure is simplified and the production cost is reduced, and, in the case of backside light emission, the aperture ratio is enhanced.

The structure illustrated in FIG. 8 will now be described in more detail.

The pixel PX includes an OLED, a driving transistor DT, a capacitor C, four switching transistors Sw1, Sw2, Sw3, Sw4, and a diode-connected compensation transistor RT.

The driving transistor DT, the four switching transistors Sw1, Sw2, Sw3, Sw4, and the compensation transistor RT each have an output terminal, an input terminal, and a control terminal. Description will now be given with respect to a pixel of the i-th row, i indicating the present row, and i−1 indicating the previous row.

The control terminal of the first switching transistor Sw1 is connected to the first gate line G1[*i*] of the present row, the input terminal thereof is connected to the data line VDATA, and the output terminal thereof is connected to the output terminal of the compensation transistor RT.

The compensation transistor RT is diode-connected, and the control and input terminals thereof are connected to the contact point A such that it is connected with the capacitor C, the driving transistor DT, and the second switching transistor Sw2.

The output terminal of the second switching transistor Sw2 is connected to the contact point A, the control terminal thereof is connected to the first gate line G1[*i*−1] of the previous row, and the input terminal thereof is connected to the driving voltage line for applying the driving voltage VDD.

The capacitor C is formed between the contact points A, B. Via the contact point A, the capacitor C is connected with the compensation transistor RT, the second switching transistor Sw2, and the driving transistor DT, and via the contact point B, the capacitor C is connected with the OLED, the fourth switching transistor Sw4, and the driving transistor DT.

The control terminal of the driving transistor DT is connected to the contact point A, the input terminal thereof is connected to the third switching transistor Sw3, and the control terminal thereof is connected to the contact point B.

The control terminal of the third switching transistor Sw3 is connected to the third gate line G3[*i*]. The input terminal thereof is connected to the driving voltage line for applying the driving voltage VDD. The output terminal thereof is connected to the input terminal of the driving transistor DT.

The control terminal of the fourth switching transistor Sw4 is connected to the second gate line G2[*i*], the input terminal thereof is connected to the reference voltage line for applying the reference voltage VREF, and the control terminal thereof is connected to the contact point B.

The switching transistors Sw1, Sw2, Sw3, Sw4, the compensation transistor RT, and the driving transistor DT may be thin film transistors (TFT), and contain polycrystalline silicon or amorphous silicon.

The anode and the cathode of the OLED are connected to the contact point B and the common voltage VCOM, respectively. The OLED emits light that is differentiated in intensity depending upon the magnitude of the current from the driving transistor DT, and the magnitude of the current depends upon the magnitude of the voltage between the control and input terminals of the driving transistor DT (the magnitude of voltage stored at the capacitor C).

With the pixel structure of FIG. 8, the pixel can be operated like that of FIG. 2 in which the driving voltage VDD has a higher value than the maximum value of the data voltage VDATA.

The pixel of FIG. 8 may be driven with the driving signals of FIG. 3 or FIG. 7. In the case of using the driving signals of FIG. 3, the OLED continuously emits light with the same luminance during the third time period (3), whereas in the case of using the driving signals of FIG. 7, the OLED does not emit light during some of the third time period (3) such that the impulsive driving may be made.

While the present invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device having a plurality of pixels, each pixel comprising:

an organic light emitting element;

a driving transistor having a driving transistor control terminal, a driving transistor input terminal, and a driving transistor output terminal, the driving transistor applying a current to the organic light emitting element through the driving transistor output terminal;

a compensation transistor having a compensation transistor control terminal, a compensation transistor input terminal, and a compensation transistor output terminal, the compensation transistor control terminal and the compensation transistor input terminal being directly connected to the driving transistor control terminal;

a first switching transistor having a first switching transistor control terminal, a first switching transistor input terminal, and a first switching transistor output terminal, the first switching transistor output terminal being connected to the compensation transistor output terminal, the first switching transistor control terminal being connected to a gate line of a present row, and the first switching transistor input terminal being connected to a data line; and a fourth switching transistor having a fourth switching transistor control terminal, a fourth switching transistor input terminal, and a fourth switching transistor output terminal, the fourth switching transistor output terminal being connected to a second contact point where the driving transistor output terminal and the organic light emitting element contact each other, the fourth switching transistor control terminal being connected to a gate line of a next row following the present row, and the fourth switching transistor input terminal being connected to a reference voltage terminal.

2. The display device of claim 1, wherein the driving transistor control terminal, the compensation transistor control terminal and the compensation transistor input terminal contact each other at a first contact point, and further comprising a second switching transistor having a second switching transistor control terminal, a second switching transistor input terminal, and a second switching transistor output terminal, the second switching transistor output terminal being connected to the first contact point, and the second switching transistor control terminal being connected to a gate line of a previous row.

3. The display device of claim 2, wherein an initial voltage is applied to the second switching transistor input terminal.

4. The display device of claim 3, wherein the initial voltage has a higher value than a maximum value of a data voltage input through the data line.

5. The display device of claim 2, further comprising a third switching transistor having a third switching transistor control terminal, a third switching transistor input terminal, and a third switching transistor output terminal, the third switching transistor output terminal being connected to the driving transistor input terminal, and the third switching transistor input terminal being connected to a driving voltage terminal.

6. A display device having a plurality of pixels, each pixel comprising:

an organic light emitting element;

a driving transistor having a driving transistor control terminal, a driving transistor input terminal, and a driving transistor output terminal, the driving transistor applying a current to the organic light emitting element through the driving transistor output terminal;

a compensation transistor having a compensation transistor control terminal, a compensation transistor input terminal, and a compensation transistor output terminal, the compensation transistor control terminal and the compensation transistor input terminal being directly connected to the driving transistor control terminal;

a first switching transistor having a first switching transistor control terminal, a first switching transistor input terminal, and a first switching transistor output terminal, the first switching transistor output terminal being connected to the compensation transistor output terminal, the first switching transistor control terminal being connected to a gate line of a present row, and the first switching transistor input terminal being connected to a data line;

wherein the driving transistor control terminal, the compensation transistor control terminal and the compensation transistor input terminal contact each other at a first contact point, and further comprising a second switching transistor having a second switching transistor control terminal, a second switching transistor input terminal, and a second switching transistor output terminal, the second switching transistor output terminal being connected to the first contact point, and the second switching transistor control terminal being connected to a gate line of a previous row, and further comprising a third switching transistor having a third switching transistor control terminal, a third switching transistor input terminal, and a third switching transistor output terminal, the third switching transistor output terminal being connected to the driving transistor input terminal, and the third switching transistor input terminal being connected to a first driving voltage terminal, wherein the second switching transistor input terminal is directly connected to a second driving voltage terminal.

7. A display device having a plurality of pixels, each pixel comprising:

an organic light emitting element;

a driving transistor having a driving transistor control terminal, a driving transistor input terminal, and a driving transistor output terminal, the driving transistor applying a current to the organic light emitting element through the driving transistor output terminal;

a compensation transistor having a compensation transistor control terminal, a compensation transistor input terminal, and a compensation transistor output terminal, the compensation transistor control terminal and the compensation transistor input terminal being connected to the driving transistor control terminal; and a first switching transistor having a first switching transistor control terminal, a first switching transistor input terminal, and a first switching transistor output terminal, the first switching transistor output terminal being connected to the compensation transistor output terminal, the first switching transistor control terminal being connected to a gate line of a present row, and the first switching transistor input terminal being connected to a data line, a second switching transistor having a second switching transistor control terminal, a second switching transistor input terminal, and a second switching transistor output terminal, the second switching transistor output terminal being connected to the first contact point, and the second switching transistor control terminal being connected to a gate line of a previous row, and a third switching transistor having a third switching transistor control terminal, a third switching transistor input terminal, and a third switching transistor output terminal, the third switching transistor output terminal being connected to the driving transistor input terminal, and the third switching transistor input terminal being connected to a driving voltage terminal, wherein the driving transistor control terminal, the compensation transistor control terminal and the compensation transistor input terminal contact each other at a first contact point, and wherein the third switching transistor control terminal is connected to a first signal line, and when a low voltage is applied to the gate line of the present row and the gate line of the previous row, a high voltage is applied to the first signal line.

8. The display device of claim 7, wherein the driving transistor output terminal and the organic light emitting element contact each other at a second contact point, and further comprising a fourth switching transistor having a fourth switching transistor control terminal, a fourth switching transistor input terminal, and a fourth switching transistor output terminal, the fourth switching transistor output terminal being connected to the second contact point, and the fourth switching transistor input terminal being connected to a reference voltage terminal.

9. The display device of claim 8, wherein the fourth switching transistor control terminal is connected to a second signal line, and when the low voltage is applied to the gate line of the present row and the gate line of the previous row, the low voltage is applied to the second signal line.

10. The display device of claim 9, wherein the low voltage applied to the first switching transistor, to the second switching transistor, to the third switching transistor and to the fourth switching transistor turns off the first switching transistor, the second switching transistor, the third switching transistor and the fourth switching transistor.

11. The display device of claim 9, wherein the low voltage applied to the first switching transistor, to the second switching transistor and to the third switching transistor turns off the first switching transistor, the second switching transistor and the third switching transistor, and the low voltage applied to the fourth switching transistor makes a predetermined magnitude of current flow through the fourth switching transistor.

12. The display device of claim 11, wherein when the low voltage is applied to the fourth switching transistor, a current of several nA flows through the fourth switching transistor.

13. The display device of claim 8, further comprising a capacitor between the first contact point and the second contact point for interconnecting the first contact point and the second contact point.

14. The display device of claim 8, further comprising:

a scan driver that generates signals applied to the control terminals of the first switching transistor, the second switching transistor, the third switching transistor and the fourth switching transistor;

a data driver that generates data voltages applied to the data line; and a signal controller that controls a scan driver and a data driver.

15. The display device of claim 2, wherein when a low voltage is applied to the gate line of the present row and the gate line of the previous row, the low voltage is applied to the second signal line.

* * * * *